US010326239B2

(12) United States Patent
Leloup

(10) Patent No.: US 10,326,239 B2
(45) Date of Patent: Jun. 18, 2019

(54) HYDRAULIC TOOL FOR UNCOUPLING A CONNECTION ASSEMBLY, IN PARTICULAR WITH MULTI-CONTACT CONNECTORS

(71) Applicant: RADIALL, Aubervilliers (FR)

(72) Inventor: Guillaume Leloup, Chateau-Renault (FR)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 16/026,619

(22) Filed: Jul. 3, 2018

(65) Prior Publication Data

US 2019/0013620 A1 Jan. 10, 2019

(30) Foreign Application Priority Data

Jul. 7, 2017 (FR) ..... 17 56439

(51) Int. Cl.

| | |
|---|---|
| ***H01R 12/71*** | (2011.01) |
| ***H01R 43/26*** | (2006.01) |
| ***H01R 13/635*** | (2006.01) |
| ***H01R 13/637*** | (2006.01) |

(52) U.S. Cl.

CPC ..... *H01R 13/637* (2013.01); *H01R 12/714* (2013.01); *H01R 13/635* (2013.01); *H01R 43/26* (2013.01)

(58) Field of Classification Search

CPC ..... B25B 27/026; H01R 43/26

See application file for complete search history.

(56) References Cited

U.S. PATENT DOCUMENTS

| | | | |
|---|---|---|---|
| 3,452,316 | A | 6/1969 | Panek et al. |
| 3,579,795 | A | 5/1971 | Burman |
| 5,062,201 | A | 11/1991 | Long, Jr. |
| 5,329,693 | A | 7/1994 | Smith |

FOREIGN PATENT DOCUMENTS

| | | | |
|---|---|---|---|
| EP | 1708313 | A2 | 10/2006 |
| EP | 2654137 | A1 | 10/2013 |
| EP | 13164039 | B1 | 10/2013 |
| FR | 1471823 | A | 3/1967 |

OTHER PUBLICATIONS

Corresponding French Application, Application No. 1756439 French Search Report, dated Mar. 26, 2018, 7 pages.

*Primary Examiner* — Briggitte R. Hammond

(74) *Attorney, Agent, or Firm* — Cooper Legal Group, LLC; Ronald M. Kachmarik

(57) ABSTRACT

A hydraulic tool for uncoupling complementary connectors in their connected configuration, the efficiency of which is guaranteed because the positioning of its head about one of the connectors guarantees the hooking of the latter and the release of at least one piston for thrust against a panel to which the other connector is fastened.

11 Claims, 6 Drawing Sheets

HYDRAULIC TOOL FOR UNCOUPLING A CONNECTION ASSEMBLY, IN PARTICULAR WITH MULTI-CONTACT CONNECTORS

The present invention relates to a connection assembly comprising connectors, in particular mutually connected multi-contact connectors.

It aims more particularly to propose a tool for uncoupling/disconnecting a connection assembly of this type.

Patent application EP 1708313 in the name of the applicant discloses a connection assembly comprising a first multi-contact connector and a second multi-contact connector of complementary type. Each connector comprises a housing receiving contacts and the connection assembly comprises a cap allowing locking of the first connector and of the second connector.

In numerous applications, one of the connectors forming a receptacle is fastened to a panel, in particular an electronic equipment panel. This fastening has to be reliable, in particular in applications where the connection assemblies are onboard assemblies, as in aircraft.

As fastening means, it is possible to cite those constituted by two screw/nut systems, each of the two screws traversing, at the same time, an opening made at a lateral end of the housing of the receptacle and an opening made in the panel beside a larger opening in which the receptacle is accommodated. In certain multi-contact connectors, these screws are able to serve as mating devices that allow the male connector and the female connector to be locked together.

The applicant has also proposed, in patent EP13164039B1, means for removable fastening of a connector receptacle to a panel, consisting of hooks prestressed by springs. This removable hooking solution allows removable mounting and/or removal of the connector receptacle vis-à-vis a panel in a very short space of time, which is advantageous on an industrial scale, in particular when it is necessary to mount/remove a large number of receptacles.

Furthermore, principally for maintenance purposes, it is necessary to disconnect/uncouple two complementary connectors of one and the same assembly when they are mutually connected.

Uncoupling of this type is required, in particular, in aeronautic applications, when it is necessary, during maintenance, to verify connector contacts. Uncouplings of this type are also necessary when performing tests in the aircraft, for example.

Currently, uncoupling is achieved manually by the lead operator, who may be assisted, as appropriate, by aid devices integrated actually within one and/or the other of the two complementary connectors when the type (commercial series) of the connector allows this. Here, it is possible to cite, for example, the screw thread of the connector marketed in accordance with series 38999 or, alternatively, the locking system of series EPXB and its screw central locking system, which, in essence, uncouples the connectors at the same time as it unlocks them.

In point of fact, this presents a certain number of major drawbacks.

For the operator, uncoupling without an aid device requires a significant force, which, moreover, is generally in an uncomfortable position and in a space that is difficult to access.

Furthermore, not infrequently, manual uncoupling is accompanied by operator injury or connector breakage.

What is more, aid devices integrated within connectors necessarily have an impact on the weight, dimensions and production costs of the connectors. This is particularly disadvantageous in onboard applications, such as in an aircraft.

Integrated aid devices of this type further require a great deal of space behind the connector.

Also, there is a significant risk of breakage of the connector since it may easily be placed in an offset position when handled by an operator.

Lastly, aid devices are still difficult to access when accessories behind connectors, such as long or short, straight or elbowed flanges, are used.

There is thus a need to improve the uncoupling of a connection assembly comprising two complementary connectors, in particular multi-contact connectors, in order to remedy the aforesaid drawbacks.

The object of the present invention is to respond to all or part of this need.

It achieves this, according to one of its aspects, with the aid of a tool for uncoupling a connection assembly, the connection assembly comprising:

- a first connector, in particular a multi-contact connector comprising hooking reliefs, and
- a second connector, in particular a multi-contact connector, of a type that complements the first connector, the second connector forming a receptacle designed to be fastened to a panel, the first and second connectors each comprising a housing extending along an axis (X) and comprising a connection face, the first and second connectors being connected together via their connection faces.

The tool being characterized in that it comprises:

- at least one hook comprising at least one hooking relief designed to interact by hooking interacting with a hooking relief of the first housing and a locking tip;
- a hydraulic circuit comprising at least one cylinder, at least one piston called main piston forming, together with the cylinder, a master cylinder, at least one conduit connecting the main piston to at least one secondary piston, it being possible for the hydraulic circuit to be actuated once the hooking of at least one relief of the first housing via the hooking relief of the hook has been achieved, thereby giving rise to the movement of the main piston that transmits the pressure of the hydraulic fluid toward the at least one secondary piston that shifts from its inactive position, in which it is locked by the locking tip until the hooking of the relief of the first housing has been achieved, to an active position, in which it is unlocked and is able thus to exert a thrust force against the panel to which the receptacle is fastened, in such a manner as to achieve the uncoupling/disconnection between the receptacle and the first connector.

According to an advantageous embodiment, the hydraulic circuit comprises at least two main pistons synchronized in movement, at least two conduits connecting the at least two main pistons to at least two secondary pistons.

According to this variant, the tool may comprise two hooks advantageously comprising at least one hooking relief designed to hook on a portion of the exterior surface of the housing of the first connector.

When the hooking reliefs of the first connector are not identical, in particular if the first connector is not symmetrical, one of the hooks may comprise, as hooking relief, an open hole whilst the other of the hooks comprises a recess or a groove as hooking relief.

According to another advantageous embodiment, the tool may comprise a support stirrup with two branches separated from one another, the free end of each of the two branches supporting a body in which an element forming one of the secondary pistons is mounted in longitudinal translation between its inactive position, in which it returns at least partially inside the body, and its active position, in which it projects more from the exterior of the body relative to its inactive position.

Advantageously, each hook is mounted so as to pivot between a locking position, in which the locking tip locks the secondary piston in its inactive position, and a hooking position, in which the hooking relief hooks on the hooking relief of the first housing whilst, simultaneously, the tip is locked from the secondary piston.

Advantageously, again, the positioning of the support stirrup about the first connector gives rise to the pivoting of each hook from its first locking position to its hooking position of the hooking relief of the housing of the first connector, then mutual actuation of the grip gives rise to the movement of each main piston, which transmits the pressure of the hydraulic fluid toward the secondary piston that shifts from its inactive position to its active position, thereby exerting a thrust force against the panel to which the receptacle is fastened, in such a manner as to achieve the uncoupling/disconnection between the latter and the first connector.

According to an advantageous variant embodiment, the tool may comprise a grip for actuation of the hydraulic circuit and an uncoupling head supporting the hooking reliefs.

The head is preferably distinct and offset from the grip.

Preferably, also, the at least one master cylinder of the hydraulic circuit is integrated into the actuation grip.

The conduits may be hydraulic hoses.

The invention further relates to the use of a tool that has just been described for achieving the uncoupling/disconnection between multi-contact connectors of a connection assembly, in particular on board an aircraft.

Thus, the invention consists in a hydraulic tool for uncoupling complementary connectors in their connected configuration, the efficiency of which is guaranteed since the positioning of its head about one of the connectors guarantees, simultaneously, the release of at least one piston for thrust against the panel to which the other connector is fastened and the hooking of one of the connector housings.

Furthermore, the manual actuation force necessary in order to implement uncoupling is reduced owing to the hydraulic circuit with master cylinder, which delivers a high fluid pressure without loss of force (deformation, friction, etc.) via a lever arm.

The advantages afforded by the tool according to the invention are numerous, and amongst them the following may be cited:

- it is no longer necessary to design connectors by providing each of them with systems to aid their uncoupling. The result of this is a saving in terms of dimensions and of weight, and also of production cost. The weight saving is particularly advantageous in the case of applications in which the connectors are onboard connectors, as in aeronautics;
- the proper positioning of the tool about the connector to be uncoupled from the complementary connector is made secured by hooks integrated into the uncoupling head;
- it is easy to offset the actuation grip from the head, which makes it possible to use the tool easily in an environment where space is limited;
- the tool may be used with all known types of connector from the moment when the connector has been previously unlocked, in particular multi-contact connectors, this being the case irrespective of accessories behind the connectors, such as flanges of different lengths, of straight form or elbowed form. Examples that may be cited here are the ARINC600, EN3682, EN4644, EN4165, MIL DTL 83527, SAE AS81659 or ARINC 404 multi-contact connector series.

The invention may be more easily understood on reading the following description of non-limiting examples of implementation thereof and on examining the appended drawing, in which.

In the present application overall, the terms "front", "rear", "upper", "lower", "interior" and "exterior" are to be considered with reference to a connection assembly with the two mutually connected connectors 8, 9 that the tool according to the invention is able to uncouple. Thus, the front face of the connector 8, which may also be denoted "connection face", is the face on the side from which the connection with the complementary connector 9 is made.

Figure 1:
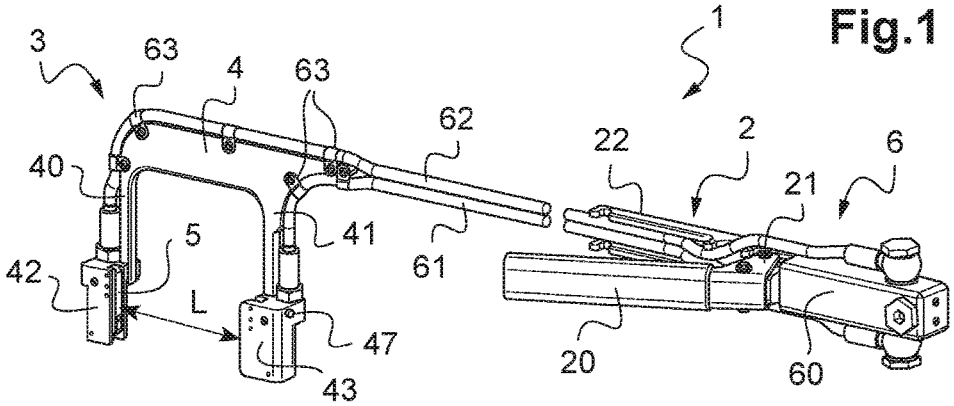
FIG. 1 is a perspective view of an example of a hydraulic tool according to the invention for uncoupling a connection assembly with a multi-contact connector.
Figure 2:
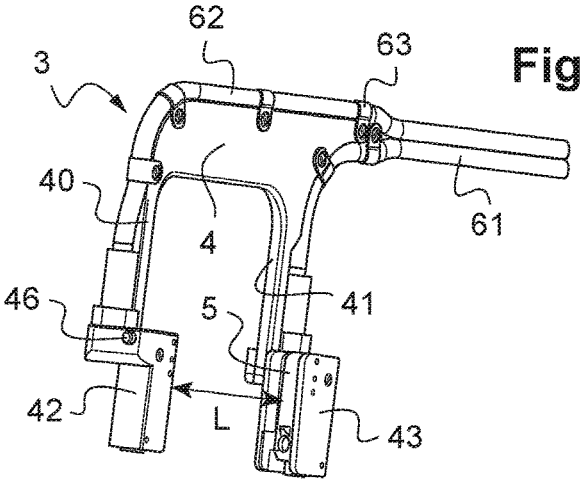
FIG. 2 is a perspective view of the head part of the hydraulic tool according to FIG. 1.
Figure 3:
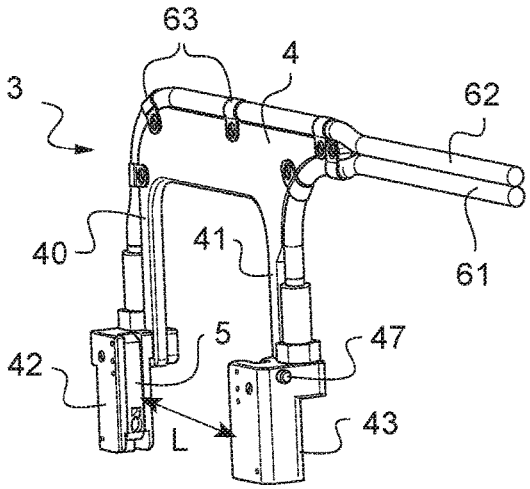
FIG. 3 is another perspective view of the head part of the hydraulic tool according to FIG. 1.

FIGS. 1 to 3 show a hydraulic tool denoted globally by the reference 1, which allows the uncoupling of a connection assembly 7 with multi-contact connectors 8, 9, as detailed below.

Figure 11:
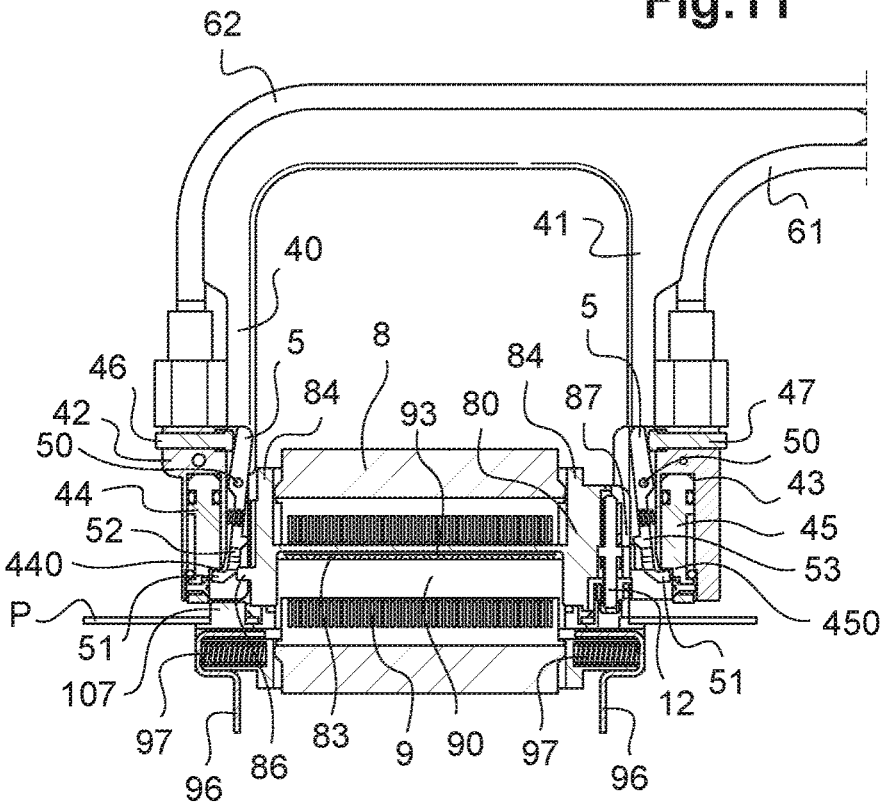
FIG. 11 is a sectional view of FIGS. 9 and 10, taken at the head of the tool positioned about the first connector, with the hooks of the tool in an intermediate position.
Figure 11A:
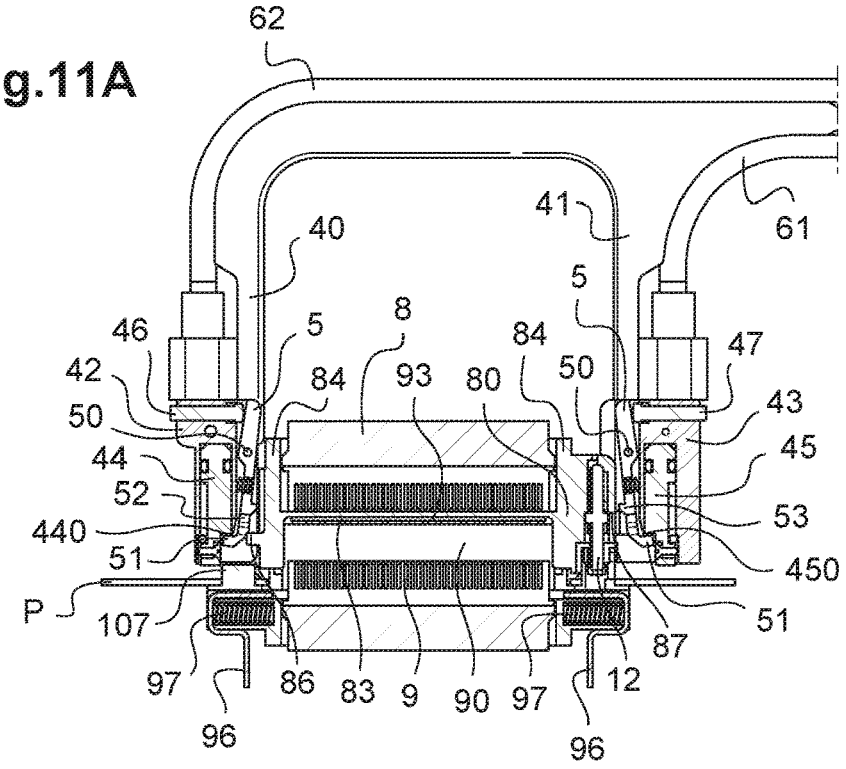
FIGS. 11A to 11C represent the various steps in uncoupling/disconnection between multi-contact connectors by the hydraulic tool according to the invention.
Figure 11B:
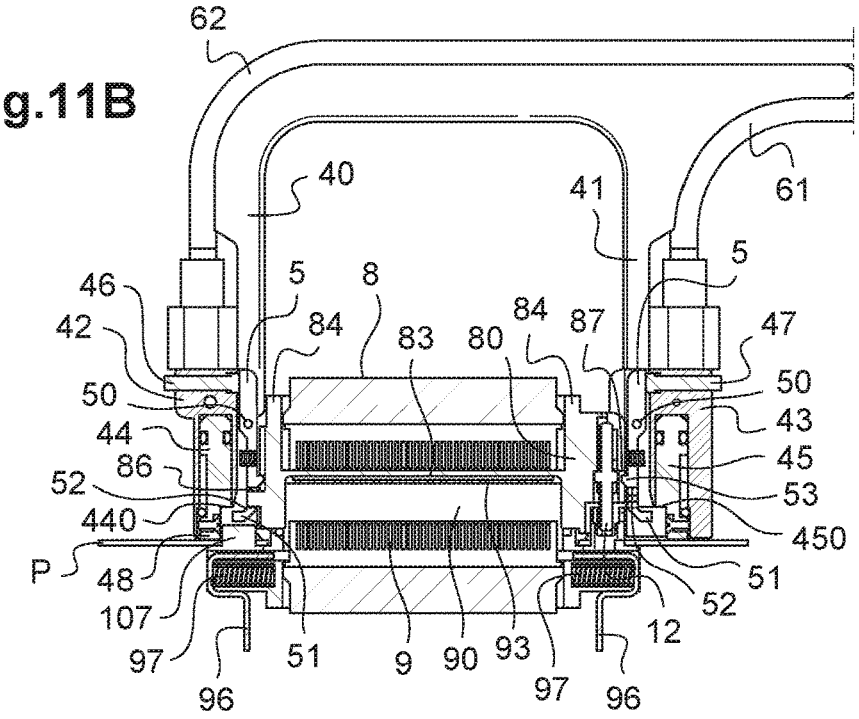
Figure 11C:
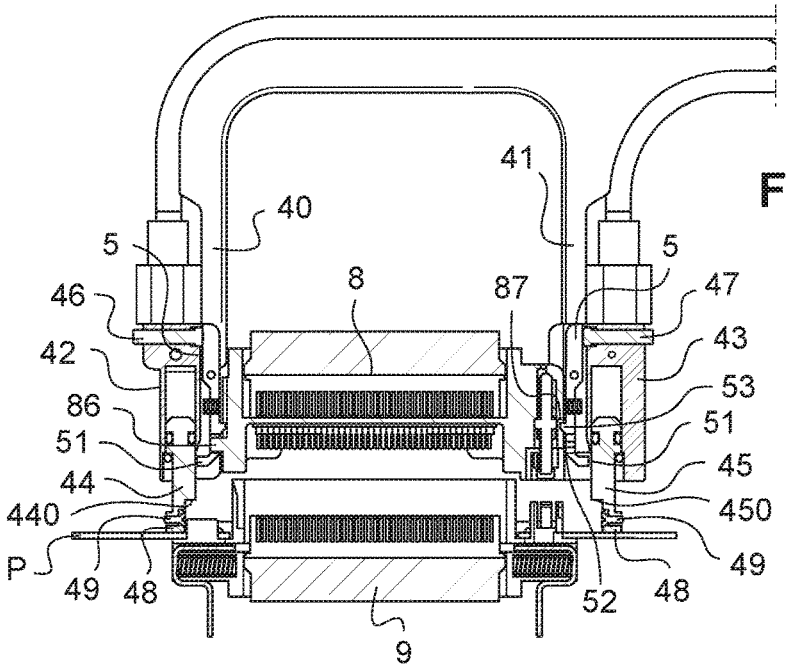

The uncoupling configuration of the connection assembly 7 by the tool 1 according to the invention is shown in FIG. 11C.

This tool 1 comprises, first, a grip 2 for actuation of a hydraulic circuit explained below and also a head 3 that is distinct and offset from the grip 2. The actuation grip 2 and the head 3 are connected together by hoses 61, 62 of the hydraulic circuit. The fact that the grip 2 is offset from the head 3 advantageously allows uncoupling between two connectors 8, 9 in an environment in which accessibility is restricted or, in other words, a reduced space.

The head 3 comprises a support stirrup 4 with two branches 40, 41 separated from one another. The free end of each of the two branches 40, 41 supports or integrates a body 42, 43.

A piston 44, 45, which constitutes a secondary piston of the hydraulic circuit 6, is mounted in longitudinal translation between an inactive position, in which it is withdrawn completely inside the body, and an active position, in which it projects from the exterior of the body relative to its inactive position.

At the free end of each of the two branches 40, 41 a hook 5 is pivotably mounted, the function of said hook being, simultaneously, to lock the secondary pistons 44, 45 in their active and inactive positions and to allow hooking of one 8 of the two connectors in order to achieve uncoupling/disconnection thereof vis-à-vis the other 9 of the two connectors of the connection assembly 7.

More precisely, as illustrated in FIG. 11, each hook 5 is mounted so as to pivot about a pin 50 on each branch 40, 41 and comprises a tip 51, the form of which is adapted to match that of a shoulder 440, 450 of a secondary piston 44, 45.

Thus, the pivoting of each hook 5 takes place between a first position, in which it allows the translation of one of the two secondary pistons 44 or 45, and an intermediate position, in which it blocks the translation of this same secondary piston 44 or 45.

More precisely, in an intermediate locking position, the tip 51 hooks on the first shoulder 440 or 450 in order to lock, that is to say to block, the pistons 44 and 45 in translation.

In order to be able to hook the connector 8 simultaneously with their pivoting, each of the hooks 5 comprises a hooking relief 52 or 53 adapted to hook on a portion of the exterior surface 86 and 87 of the housing 80 of the connector 8 when said hook is in its first position after passing via the intermediate position upon positioning of the head 3 of the tool on the housing 80 of the connector 8.

In order to bring each of the two hooks 5 back into its intermediate position from its first position, doing so in the absence of pressure in the hydraulic circuit 6, a button 46, 47 is mounted so as to slide transversely in each of the two branches 40, 41. Thus, an operator is able to press, from the exterior, on one and/or the other of the buttons 46, 47 in order to bring the hook or hooks 5 back into the intermediate position thereof, allowing the unsecuring of the connector 8 of the uncoupling head 3.

Figure 12:
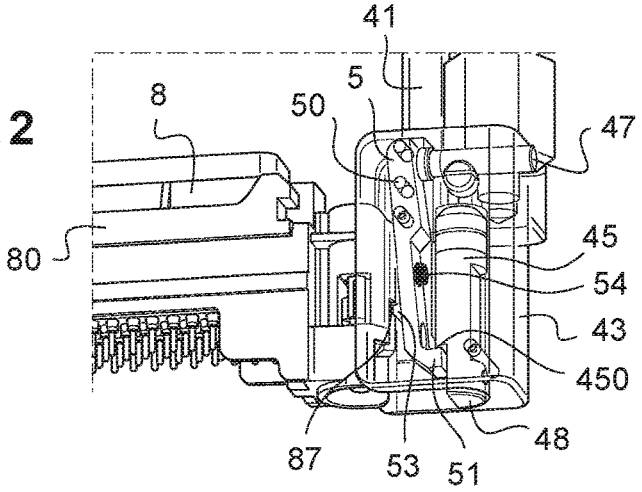
FIGS. 12 and 13 are detailed views showing, by means of transparency, the hooks of the tool in an intermediate position of covering the first connector prior to the actual uncoupling operation.
Figure 13:
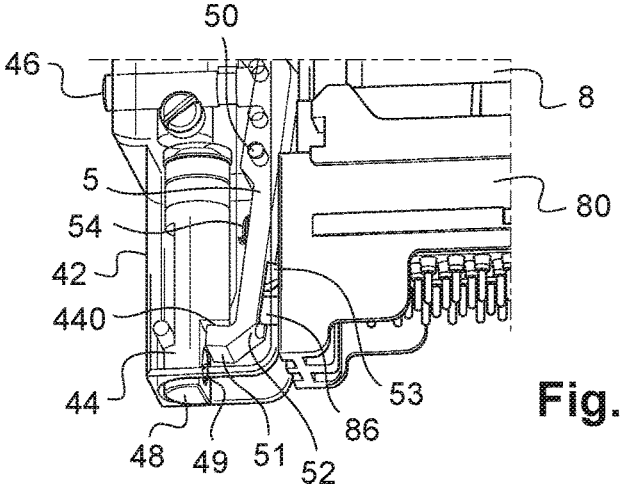

In the embodiment illustrated in FIGS. 11 to 13, each of the two secondary pistons 44, 45 may be equipped with a shock-absorbing pad 48 screwed by means of a screw 49 to the body of the secondary piston. These pads 48 make it possible to damp the bearing of the pistons 44, 45 against the panel and thus to not mark the panel upon uncoupling of the connectors with the tool according to the invention.

In the embodiment illustrated in FIGS. 11 and 11A to 11C, owing to the fact that the two lateral sides of the housing 80 of the connector 8 are not symmetrical, the hooking reliefs 52, 53 differ from one hook 5 to another. Thus, the hooking relief 52 is an open hole made through one of the hooks 5, whilst the hooking relief 53 of the other hook 5 is a notch made on the interior wall of the latter.

Figure 4:
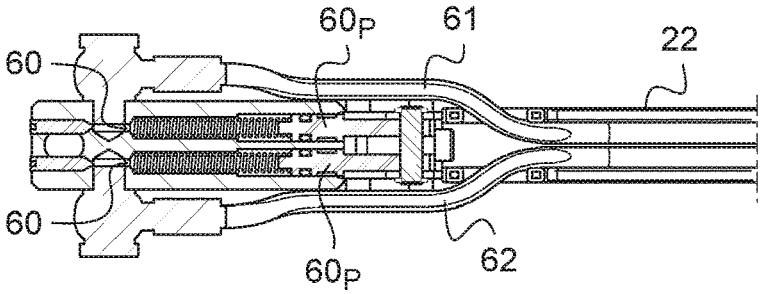
FIG. 4 is a longitudinal sectional view of the double master cylinder of the hydraulic circuit of the tool according to the invention.

The hydraulic circuit 6, which may be actuated by the grip 2, comprises at least two cylinders 60 and at least two main pistons $\mathbf{60}_P$ synchronized in movement, forming, together with the cylinders 60, two master cylinders. FIG. 4 shows in detail the interior of the double master cylinder inside which the two main pistons move in a synchronous manner through actuation of the grip 2, 22.

Each of the two hydraulic hoses 61, 62 thus connects the cylinders 60 to each body 42, 43 of the support stirrup. The two hoses 61, 62 may be fastened by means of a fastening collar 63 along the support stirrup 4.

Figure 9:
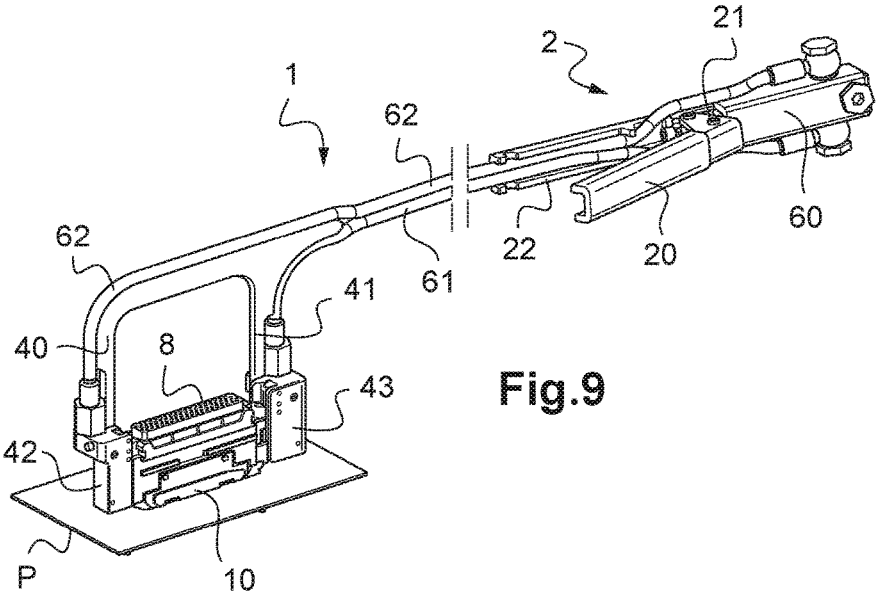
FIGS. 9 and 10 are perspective views of the hydraulic tool according to FIGS. 1 to 3 in the configuration of uncoupling of the multi-contact connection assembly illustrated in FIGS. 5 to 8.
Figure 10:
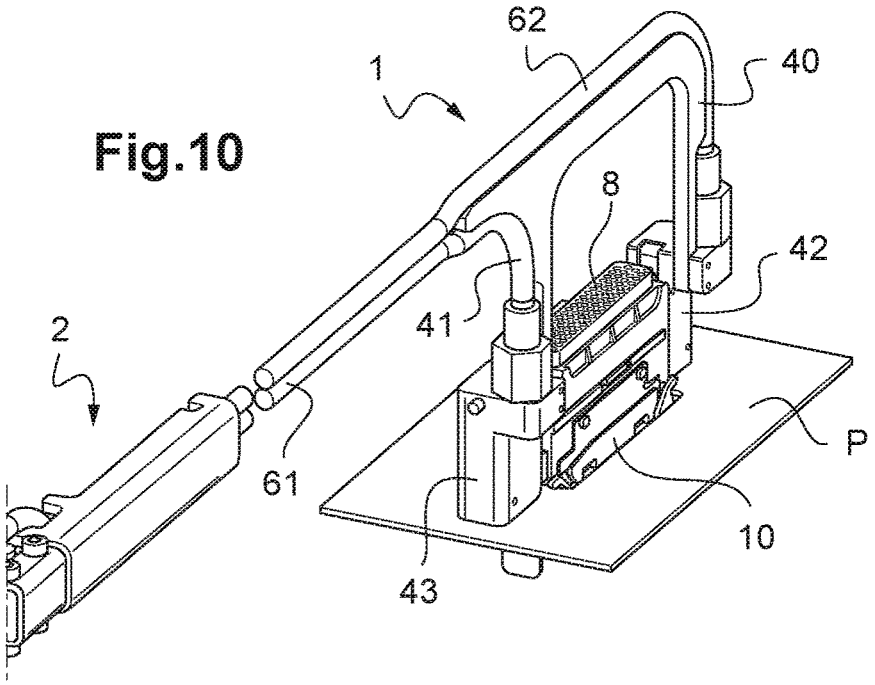

In the embodiment illustrated in FIGS. 1, 9 and 10, the actuation grip 2 integrates, within, the master cylinders 60 of the hydraulic circuit 6. The actuation lever 20 of the grip 2 is mounted pivotably on the master cylinders 60 about a pin 21 whilst the other branch 22 of the grip is fastened rigidly to the master cylinder 6 and, furthermore, partially accommodates the hydraulic hoses 61, 62.

FIGS. 5 to 8 show the two complementary multi-contact connectors 8, 9 of a connection assembly 7, which is designed to be uncoupled using a hydraulic tool 1 that has just been described.

The first connector 8 is, for example, of male type, in particular a plug, whilst the second connector 9 is of female type, in particular a receptacle. The receptacle 1 may also be of male type and the plug 8 of female type.

Overall, in the figures described, the first connector 8 is a socket and the second connector 9 is a male receptacle, and these first and second connectors have a general cross section perpendicular to their longitudinal axis X of rectangular form.

Each multi-contact connector 8, 9 is designed to convey optical, electrical or power signals. In a variant, signals or power of different types may be conveyed by each of the multi-contact connectors and contacts of different type and size are thus simultaneously arranged within.

The contacts may be simple or multiple contacts, such as coaxial or triaxial contacts, quadrax contacts, RJ45 contacts, or any type of high throughput contact. These contacts may also be optical contacts with lens-equipped contacts of "expanded beam" type or "physical contact" contacts of ARINC 801 or EN 4531 type, or, furthermore, optoelectronic contacts.

The first multi-contact connector 8 comprises, first, a housing 80 that is, in the example described, produced as a single piece or a plurality of pieces in order to facilitate the positioning of maintenance pieces.

The housing 80 comprises a plurality of cells 81, made in the housing 80, from a rear face 82 up to a front face 83, which may also be denoted "connection face", opposite the second connector 9 when the connectors 8 and 9 are connected together.

In the example described, the front 83 and rear 82 faces are parallel and extend perpendicularly to the rectilinear axis of the cells 81.

The housing 80 may comprise two guide arms 84 extending beyond the connection face 83 on either side of the latter.

Although not shown, the first connector 8 may comprise an attachment part extending as an extension of the housing 80 along the longitudinal axis X from the rear face. This attachment part may comprise, for example, two branches each having an end removably attached to the housing 80 and another end connected to a join part. The join part may define a plurality of attachment zones. Although not shown, each attachment zone may have a semicircular reception surface on which the cables to which the first connector 8 is connected may bear and/or be fastened.

The first connector 8 may comprise a front seal (not shown) to be arranged on the connection face 83 of the housing 80 and this front seal may comprise passages that are placed opposite the cells 81 when the seal is positioned on the connection face 83. The front seal is, for example, made from silicone.

The first connector 8 may comprise a rear seal to be arranged against the rear face 82 of the housing 80. Like the front seal, this rear seal may comprise as many passages as the housing 80 comprises cells 81, the passages in the rear seal being placed opposite the cells 81 when the rear seal is positioned on the rear face of the housing.

The cells 81 receive a portion of the contacts (not shown) of the first connector 8. The contacts may comprise a portion received in the cells 81 and a portion projecting beyond the connection face 83 of the housing 8. The portion received in the cells 81 may have a length of between 50 and 75% of the length of the contacts.

A maintenance piece (not shown) may be arranged in each cell 81 close to the rear face, it being possible for this maintenance piece to fasten a contact in the housing 80. In a variant, the maintenance pieces may be molded and integrated into the housing 80, in particular when the housing 80 is produced as two parts.

The first connector 8 comprises, at one of its lateral ends, an excrescence 85 forming a casing of cylindrical interior form over the greater part of its height, which constitutes its bottom. This casing 85 forms a female mating device, as explained below.

At the other of its lateral ends, the first connector 8 comprises a stud 86 that projects toward the exterior. In the embodiment illustrated, this stud 86 allows sensitive manual inspection by the operator in order to verify the unlocked position of the locking cap 10 explained below.

Figure 7:
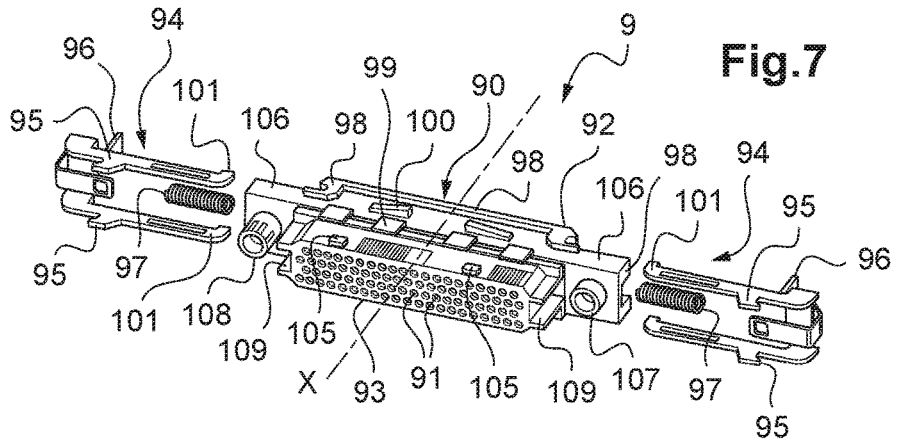
FIGS. 7 and 8 are perspective views of the second multi-contact connector, forming a receptacle, of the connection assembly for which the hydraulic uncoupling tool is designed, FIG. 8 showing the fastened configuration of the receptacle to an electronic equipment panel.
Figure 8:
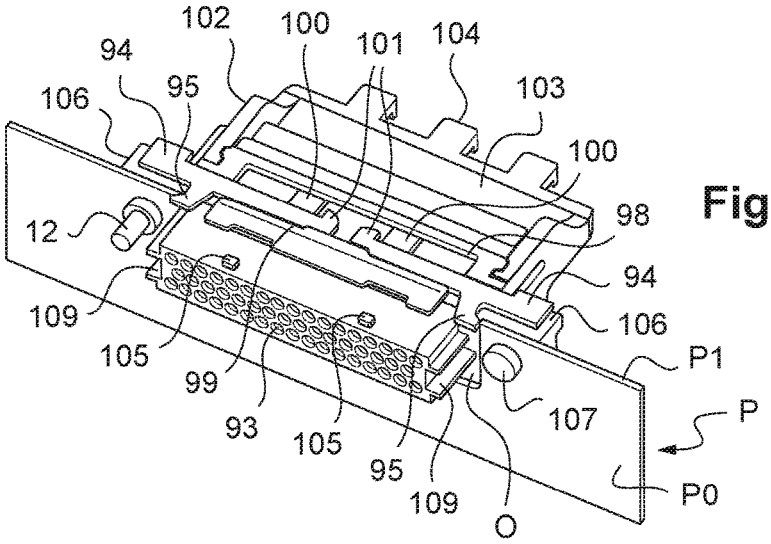

FIGS. 7 and 8 show a receptacle 9 of a multi-contact connector designed to be connected to the first multi-contact connector that has just been described.

The connector receptacle 9 also comprises a housing 90, which, in the example described, is produced as a single piece made from plastics.

The housing 90 comprises a plurality of cells 91 made in the housing 90, from a rear face 92 up to a front face 93, which may also be denoted "connection face".

In the example described, the faces 92 and 93 are parallel and extend perpendicularly to the rectilinear axis X of the cells 93, this rectilinear axis X constituting the axis of the housing.

As illustrated in FIG. 7, the multi-contact connector receptacle 9 includes two hooking pieces 94, each comprising at least one hook 95 for fastening the housing, which are each mounted so as to slide on the housing 90, perpendicular to the axis X thereof, between at least one retracted release position and at least one deployed fastening position.

The two hooking pieces 94 separate from one another when they each slide from their retracted position toward their deployed position.

Each hooking piece 94 comprises a tongue 96 each serving as support for one of the operator's fingers and extending parallel to the axis X on the side of the rear face 92 of the housing 90 and the rear face 93 of the panel P.

Two springs 97, distinct from the hooking pieces 94, are each mounted freely in a casing 98 of the housing 90, being partly bearing against the latter and partly bearing against a hooking piece 94. Each spring 97 exerts a thrust force on the housing 90, perpendicularly to the axis X of the housing, at least in a deployed position and in the absence of bearing on a corresponding tongue 96. Each spring 97 is a helical compression spring. Each spring 97 may be mounted in such a manner as to be prestressed in the extreme deployed position of fastening the hooking piece 7 against which it bears.

The housing 90 may comprise a first rib 98 that extends perpendicularly to the axis X over all or part of the upper face of the housing. A second rib 99 is made on the upper face of the housing and extends parallel to the first rib 98 in the central portion thereof.

The housing 90 comprises, lastly, two elongate reliefs 100, each in the form of an inclined slope, extending in the extension of the end portions of the first rib 98.

The central portion of the first rib 98 is, in the example illustrated, made on the upper face of the housing 90 and delimits the edge of the rear face 92 of the housing. The end portions of the first rib 98 delimit an edge of the lateral ends of the housing.

As illustrated more clearly in FIGS. 7 and 8, each hooking piece 94 may comprise a maintenance tab 101 that is curved at its end in order to abut against an elongate relief 100 in the extreme deployed position of fastening the piece 94.

The dimensions of the opening O and the thickness of the panel P in which a receptacle 9 is fastened may be such that, in the fastened configuration, the curved end of the maintenance tab 101 does not abut against a relief 100. Indeed, in a fastened configuration, the hooking piece 94 is in an intermediate deployed position, or in other words it is not deployed to its maximum travel.

The first 98 and second 99 ribs, and also the reliefs 100, together define a slide for sliding of the hooking piece 94 perpendicularly to the axis X of the housing 90.

In this receptacle 9, the hooking piece 94 is snap-fitted on the housing 90 and is able to slide from this extreme deployed fastening position to an extreme retracted release position.

This extreme release position may be achieved by abutment of the tongues 96 against parts 102 connected to the housing 90. It may also be achieved by abutment of the tongues 96 against the housing 90. It may, furthermore, be achieved by mutual abutment between the two maintenance tabs 101 opposite one another, i.e. sliding over the same upper face of the housing in the same direction perpendicular to the axis X.

When a connector receptacle 9 is not in a configuration where it is fastened to a panel P, and in the absence of bearing on the tongues 96, the hooking pieces 94 are in the extreme deployed position and are held by the reliefs 100 interacting with the maintenance tabs 101. Preferably, in this extreme deployed position, the springs 97 are in the prestressed state.

When a connector receptacle 9 is in a configuration where it is fastened to a panel P, and in the absence of bearing on the tongues 96, the hooking pieces 94 are in an intermediate deployed position and are not held by the reliefs 101 but are held by the hooks 95 against the opening O of the panel P and interacting with the face P0 of the panel P.

As illustrated more clearly in FIGS. 7 and 8, a hooking piece 94 may advantageously comprise two hooks 95, one of which slides over the upper face of the housing and the other of which slides over the lower face of the housing. Thus, it is possible thereby to achieve a fastening of the receptacle 9 with four fastening hooks 95 of the housing. This allows better mechanical behavior, in particular in the event of severe tensile stresses on the receptacle 9 toward the rear of the panel P or severe tensile stresses in a direction perpendicular to the axis X.

As may be seen more clearly in FIG. 8, the connector receptacle 9 may comprise an attachment component 103 extending in the extension of the housing 3 along the axis X from the rear face. The attachment component 103 has a plurality of attachment zones 104.

As FIGS. 7 and 8 show, one or a plurality of locking studs 105 may be provided at least on the upper face of the housing. Other locking studs may also be provided on the lower face of the housing 90. These locking studs 105 are, in the examples considered, produced as a single piece with the housing 90. These locking studs 105 are configured in order to interact with the notches or apertures 11 made in a locking cap 10 mounted slidably on the housing 80 of the first connector 8, as detailed below.

The connector receptacle 9 may, on each of its lateral ends, comprise an excrescence 106 serving as 2 surface for planar bearing against the rear face PI of the panel P. A guide stud 107 configured in order to interact with an opening of a panel P may project from one of the hearing surfaces 106.

A male mating device 12 or coding key is mounted in a complementary cylindrical casing 108 that projects from the other of the bearing surfaces 106. This coding key 12 is configured in order to interact with the female mating device 85 of the plug 8 that complements the receptacle 9.

It is specified, here, that, in the examples illustrated, the guide stud 107 and the male mating device 12/108 do not serve as means for fastening the receptacle 9 but, as appropriate, one and/or the other of the stud 107 or of the mating device 108 could be used to achieve a complementary fastening of the screw/nut type.

Lastly, the housing 90 may comprise, at each of its lateral ends, a groove 109 provided front the front face 91 of the housing, which extends parallel to its axis X. This may also be a solid portion. These grooves or solid portions 109 are designed to interact with the guide arms 84 of the plug 8 upon connection with the receptacle 9.

Figure 5:
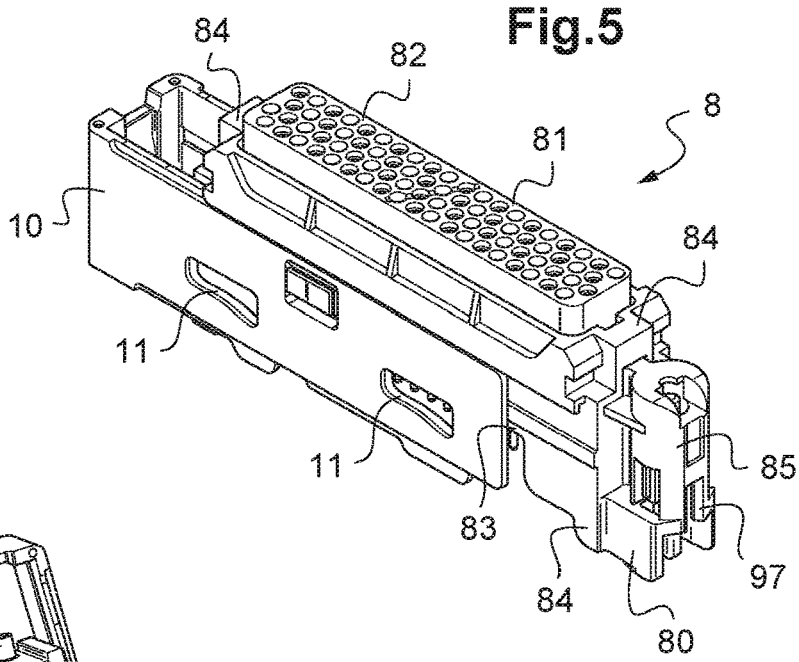
FIGS. 5 and 6 are perspective views of the first multi-contact connector of the connection assembly for which the hydraulic uncoupling tool is designed.
Figure 6:
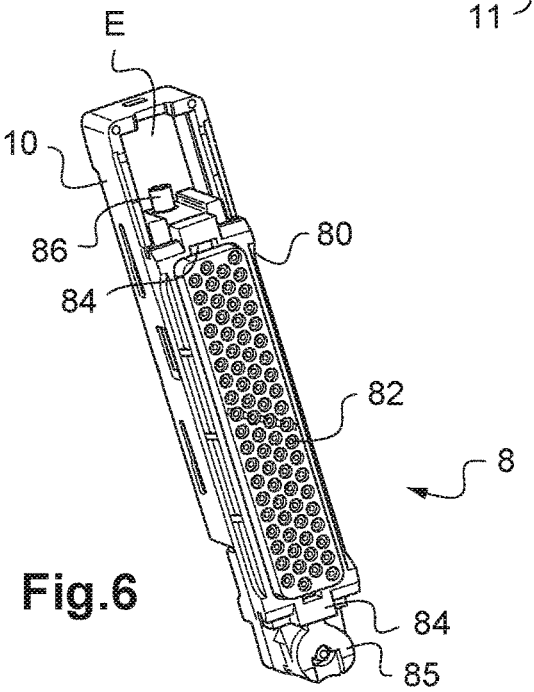

The two multi-contact connectors 8, 9 of the connection assembly are advantageously configured in order to be locked together. As illustrated in FIGS. 5 and 6, locking may be achieved advantageously by a locking cap 10 mounted so as to slide transversely relative to the housing 80 of the first connector 8, between a locking position and an unlocking position, and vice versa.

As shown more clearly in FIGS. 5 and 6, this locking cap 10 may have a U-form in cross section in a plane perpendicular to the axis X of the connector 8. The cap 6 then comprises a bottom facing a lateral face of the housing 80 and two parallel branches positioned, respectively, opposite a part of the upper face of the housing 80 and a part of the lower face of the housing 80.

As shown in FIG. 5, one or a plurality of windows or apertures 11 may be provided in one of the branches, or even in each branch. These windows may, when observed in plan view or in bottom view of the housing 80, have a substantially L-form. The greater dimension, measured between the two opposite edges of a window 11, defines the amplitude of the sliding movement of the locking cap 10 relative to the housing 80 when it passes from a locking position to an unlocking position.

In order to achieve mutual locking between the first connector 8 and the second connector 9, the following procedure is adopted.

In a first step, the first connector 8 with the locking cap 10 in the unlocked position is pushed, for example manually, toward the receptacle 9 that has been previously introduced via an opening O of the panel P and secured to this panel by the hooks 94. After this step, the locking cap 10 is in contact with the housings 80 and 90. Still after this step, the locking studs 105 of the housing 90 are received in the small portion of the L formed by each aperture 11 of the locking cap 10.

In a subsequent step, a force is exerted, for example manually, perpendicularly to the axis X. This force gives rise to the sliding of the locking cap 10 relative to the housings 80 and 90, transversely to the axis X.

The sliding of the cap 10 gives rise to the advance of each stud 105 along the large portion of the L of each aperture 11. At the end of this step, each stud 105 abuts against an edge of the aperture groove and is blocked in the latter. The cap 10 is then in the locked position, securing the connectors 8 and 9 together.

As shown in FIG. 6, in the unlocking position, a free space E is cleared between the bottom of the cap 10 and the lateral edge of the housing of the connector 8.

A description will now be given with reference to FIGS. 11A to 11C of the use of the hydraulic tool 1 according to the invention by an operator, which allows uncoupling between connectors 8, 9 of one and the same connection assembly when the connectors 8, 9 are connected and locked together.

First, the locking cap 10 is unlocked and brought into its unlocking position, which clears the space E between the bottom of the cap and the lateral edge of the housing 80.

Then, the head 3 of the tool 1 is positioned such that the support stirrup 4 covers, to an extent, the first connector 8 with the branches 40, 41 on either side of the housing 80. In this position, the body 42 at the end of the branch 40 is accommodated in the space E cleared by the unlocked cap 10 and the body 43 of the end of the other branch 41 bears on the retention system of the mating key 12 (FIG. 11A).

In this covering position, as may be seen in FIG. 11A, the bearing branches 40 and 41 of the uncoupling head piece 3 bear against the lateral portions of the housing 80 at the rear of the latter. In this position, also, no pressure has been created in the hydraulic circuit 6. The pistons 44, 45 are thus in their inactive position and the hooks 5 rock in their intermediate position, in which their tips 51 hook on the first shoulders 440, 450 of the pistons 44, 45 (FIGS. 12 and 13).

A helical spring 54 arranged transversely to each hook 5 advantageously allows the piston 44 or 45 to be brought back to vertical. These springs 54 are compressed by the passage of the shoulders upon engagement of the head of the tool.

Then, the thrust of the head 3 is continued in the direction of the panel P, which gives rise to the hearing of the hooks 5 against the housing 80 and thus simultaneous pivoting thereof about their pin 50, in their first position in which the other reliefs 52, 53 hook on two portions of the exterior surface of the housing 80 (FIG. 11B).

More precisely, the open hole 52 of one of the hooks 5 snap-fits about the stud 86 of the housing 80 and the recess 53 of the other hook 5 hooks on a portion 87 of the housing about the mating/coding key 85.

In this first position, the pistons 44, 45 are free to move in their respective body 42, 43 since none of the hooks 5 locks them, that is to say does not block them in translation. In other words, the shoulders 440, 450 of the pistons 44, 45 are remote from the hooks 5.

Provision may advantageously be made for this configuration to correspond to a bearing of the pistons 44, 45 against the panel P.

The grip 2 is then manually actuated, which gives rise to the movement of the synchronized main pistons, which transmit the pressure of the hydraulic fluid through the hydraulic circuit 6 toward the two secondary pistons 44, 45.

These two pistons 44, 45 then shift from their inactive position to their active position, thereby exerting a simultaneous and symmetrical thrust force on either side of the connector 8 against the panel P to which the receptacle 9 is fastened. The pads 48 make it possible to damp the bearing force of the pistons 44, 45 against the panel P and thus not to mark the latter.

This thrust force allows a withdrawal of the head 3 to which the first connector 8 is secured by means of the reliefs 52, 53 of the hooks 5.

The travel of the pistons 44, 45 generated by the hydraulic pressure from the grip 2 allows complete withdrawal until complete uncoupling/disconnection between the receptacle 9 and the head 3/connector 8 integral assembly is achieved (FIG. 11C).

Owing to the simultaneous and symmetrical thrust force of the pistons 44, 45, uncoupling is symmetrical and takes place in the axis X of the contacts, which guarantees the integrity of the latter. Furthermore, the manual actuation force to be applied on the grip 2, which is necessary for uncoupling, is reduced owing to the significant scaling-down linked to the use of the lever arm of the grip and transmitted with a minimum of losses as far as the connector by means of the pressure of the fluid in the hydraulic circuit 6.

Once complete uncoupling has been achieved, the grip 2 may then be released and the pistons 44, 45 are restored to their inactive position, i.e. withdrawn into their respective casings.

In order, finally, to unsecure the connector 8 from the head 3, it suffices to hear on the two buttons 46, 47 located on either side of the support stirrup 4. This bearing gives rise to the movement of the buttons 46, 47 toward the interior of the stirrup 4 and thus the pivoting of the hooks 5 and their return into their intermediate position in which they once again lock the pistons 44, 45 via their shoulders 440, 450. The release of the connector of the tool occurs only upon supplementary manual operation, which makes it possible to release the connector of the tool only at the chosen moment.

Other variants and improvements may be provided without thereby departing from the scope of the invention.

Thus, the examples illustrated, uncoupling with the tool according to the invention is achieved in the case of two multi-contact connectors of QR-series type, and the tool according to the invention may be applied to all types of connector provided they have hooking reliefs that complement those of the tool. Here, the series of multi-contact connectors ARINC600, EN3682, EN4644, EN4165, MIL DTL 83527, SAE AS81659 or ARINC 404 may be cited. Circular connectors may also be envisaged.

Likewise, the illustrated examples relate to an uncoupling tool with two main pistons synchronized in movement in order to cause two secondary pistons to bear simultaneously on either side of the connectors. However, it is also possible to envisage a tool with a hydraulic circuit that would move a single secondary piston of generally annular form, which would initially be positioned about circular connectors, and the thrust thereof against the panel would be uniform and in an annular zone.

Furthermore, the illustrated locking/unlocking system between connectors is constituted by a locking cap that is made to slide transversely relative to the connector housing. However, any other system of manual locking/unlocking prior to uncoupling according to the invention may be envisaged.

Moreover, although, in the examples illustrated, the hydraulic tool according to the invention serves to achieve uncoupling between connectors of rectangular general cross section, it is possible to envisage achieving a tool for connectors having a different cross section, such as connectors with a circular cross section.

Furthermore, in the examples illustrated, the two hooks of the tool that hook on either side of the exterior surface of the connector housing are not identical owing to the different hooking reliefs: an open hole on the one hand and a recess or groove on the other. It is also possible to achieve a tool in which the head has two identical hooks.

In the embodiments illustrated, the grip of the tool is offset from the head in order to make it possible to achieve uncoupling/disconnection in a reduced space. It is also possible to achieve a monobloc assembly that would simultaneously incorporate the grip and the head with its support stirrup.

The invention is not limited to the examples just described. It is possible, in particular, to combine together characteristics from the examples illustrated within variants that are not illustrated.

The expression "comprising a/one" must be understood as meaning "comprising at least one", unless the contrary is specified.

The invention claimed is:

1. A tool for uncoupling a connection assembly which comprises a first connector, in particular a multi-contact connector comprising hooking reliefs, and a second connector, in particular a multi-contact connector, of a type that complements the first connector, the second connector forming a receptacle designed to be fastened to a panel, the first and second connectors each comprising a housing extending along an axis and comprising a connection face, the first and second connectors being connected together via their connection faces, the tool comprising:

at least one hook comprising at least one hooking relief designed to interact by hooking to a hooking relief of the first housing and a locking tip;

a hydraulic circuit comprising at least one cylinder, at least one piston called main piston forming, together with the cylinder, a master cylinder, at least one conduit connecting the main piston to at least one secondary piston, in which the hydraulic circuit is actuated once the hooking of at least one relief of the first housing via the hooking relief of the hook has been achieved, thereby giving rise to the movement of the main piston that transmits the pressure of the hydraulic fluid toward the at least one secondary piston that shifts from an inactive position, in which the at least one secondary piston is locked by the locking tip until the hooking of the relief of the first housing has been achieved, to an active position, in which the at least one secondary piston is unlocked and is able thus to exert a thrust force against the panel to which the receptacle is fastened, in such a manner as to achieve the uncoupling/disconnection between the receptacle and the first connector, wherein each hook is mounted so as to pivot between a locking position, in which the locking tip locks the secondary piston in its the inactive position, and a hooking position, in which the hooking relief hooks the hooking relief of the first housing whilst, simultaneously, the tip is unlocked from the secondary piston.

2. The tool according to claim 1, wherein the hydraulic circuit comprises at least two main pistons synchronized in movement, at least two conduits connecting the at least two main pistons to at least two secondary pistons.

3. The tool according to claim 1, comprising two hooks each comprising at least one hooking relief designed to hook on a portion of the exterior surface of the housing of the first connector.

4. The tool according to claim 3, wherein one of the hooks comprises, as hooking relief, an open hole whilst the other of the hooks comprises a recess or a groove as hooking relief.

5. The tool according to claim 1, wherein the tool comprises a support stirrup with two branches separated from one another, the free end of each of the two branches supporting a body in which an element forming one of the secondary pistons is mounted in longitudinal translation between the inactive position, in which the secondary piston returns at least partially inside the body, and the active position, in which the secondary piston projects more from the exterior of the body relative to the inactive position.

6. The tool according to claim 5, wherein a positioning of the support stirrup about the first connector gives rise to a pivoting of each hook from a locking position to a hooking position of the hooking relief of the housing of the first connector, then mutual actuation of the grip gives rise to the movement of each main piston, which transmits the pressure of the hydraulic fluid toward the secondary piston that shifts from the inactive position to the active position, thereby exerting a thrust force against the panel to which the receptacle is fastened, in such a manner as to achieve the uncoupling/disconnection between the latter and the first connector.

7. The tool according to claim 1, wherein the tool comprises a grip for actuation of the hydraulic circuit and an uncoupling head supporting the hooking reliefs.

8. The tool according to claim 7, wherein the head is distinct and offset from the grip.

9. The tool according to claim 7, wherein the at least one master cylinder of the hydraulic circuit is integrated into the actuation grip.

10. The tool according to claim 1, wherein the conduits are hydraulic hoses.

11. Use of a tool according to claim 1 for achieving the uncoupling/disconnection between multi-contact connectors of a connection assembly.

* * * * *